United States Patent [19]

King et al.

[11] 4,362,391

[45] Dec. 7, 1982

[54] WATCH WITH A CALENDAR DISPLAY AND HAND SETTING DEVICE ACTUATED BY A SETTING SHAFT

[75] Inventors: Josef King; Wolfgang Ganter, both of Schramberg, Fed. Rep. of Germany

[73] Assignee: Gebruder Junghans GmbH, Schramberg, Fed. Rep. of Germany

[21] Appl. No.: 208,017

[22] Filed: Nov. 18, 1980

[30] Foreign Application Priority Data

Nov. 24, 1979 [DE] Fed. Rep. of Germany ..... 2947400

[51] Int. Cl.[3] ..... G04B 19/24; G04C 17/00

[52] U.S. Cl. ..... 368/34; 368/69

[58] Field of Search ..... 368/34, 28, 31, 32, 368/35, 36, 37

[56] References Cited

U.S. PATENT DOCUMENTS

| | | | |
|---|---|---|---|
| 3,470,687 | 10/1969 | Tsuneyoshiono et al. | 368/32 |
| 3,693,345 | 9/1972 | Schneider | 368/36 |
| 3,983,691 | 10/1976 | Scholler et al. | 368/31 |
| 4,244,038 | 1/1981 | Ganter et al. | 368/35 |

OTHER PUBLICATIONS

Durowe, German Patent Application No. 2,004,224 published Aug. 12, 1971.

Ebauches, German Patent Application No. 2,253,505 published May 10, 1973.

*Primary Examiner*—J. V. Truhe
*Assistant Examiner*—Arthur G. Evans
*Attorney, Agent, or Firm*—Burns, Doane, Swecker & Mathis

[57] ABSTRACT

A watch with a calendar display and a hand setting device actuated by a setting shaft for correction measures as a function of the instantaneous position of the setting shaft is disclosed. For this purpose, a coupling element is rotatably coupled with the setting shaft. The coupling element is displaceable from an intermediate position into one of two preparatory positions dependent upon the direction of rotation of the setting shaft in a first axial position. By moving the setting shaft into a second axial position, the coupling element is transferred by a reversing lever and a slotted link from the preselected preparatory position into a corresponding one of two stable working positions. In the working positions, a rotatable connection is established between the setting shaft and one of the calendar display disks. With a further axial displacement of the setting shaft, the coupling element is returned into the intermediate position and a rotatable connection is established between the setting shaft and a minute hand correcting tube.

14 Claims, 7 Drawing Figures

WATCH WITH A CALENDAR DISPLAY AND HAND SETTING DEVICE ACTUATED BY A SETTING SHAFT

BACKGROUND AND SUMMARY OF THE PRESENT INVENTION

The present invention relates to watches with calendar displays. More particularly, the present invention relates to watches having calendar displays and hands drives that are rotatably coupled to a setting shaft according to the axial position of the shaft.

A wrist watch with a setting shaft that may be locked in two different axial positions is known from German DE-AS No. 2,253,505. In the first or preselection axial position, a rocker ratcheting through an intermediate correcting wheel of the setting shaft is deflected against an elastic restoring force during manual rotation of the setting shaft in one direction. The rocker acts as an actuating lever, when the setting shaft is pulled into the second axial position, for a coupling element that may be switched between two working positions. Following preselection, i.e., the rotation of the setting shaft in one direction in the first axial position to deflect the rocker from the rest position, a rotating clutch drive connection is established between the setting shaft and a hand setting gear to engage the hour gear. In other words, after the moving of the setting shaft into the pulled-out or second position, the hands may be rotated in the one or the other direction manually, by a rotating motion of the setting shaft. If preselection has occurred by rotating the setting shaft in the opposite direction in the depressed or first axial position, the rocker is deflected in the reverse direction and upon the pulling of the setting shaft to the second position a rotating clutch connection is established by the coupling element between the setting shaft and the monthly date display disk (without engaging the hand drive gear). The rotation of the pulled-out setting shaft effects the forward movement of the date display disk, together with the day-of-the-week display disk. The-day-of-the-week display disk is actuated by a free-wheeling ratchet bevel gear drive which is disengaged from the day-of-the-week display disk during a rotation of the date display disk in the opposite direction.

A disadvantage of this known watch equipped with a setting device is the complicated structure and the mode of operation of the rocker as the preselector and the actuating device for the switching of the coupling element. This complex structure may be susceptible to wear. Also, from the standpoint of handling, the lack of an apparatus for the independent setting of the day-of-the-week display disk may be inconvenient. Furthermore, the use of a common coupling element to establish clutch drive connections to both the calendar display and the time indicators has proved to be highly space consuming, which is contrary to the trend of constantly decreasing the dimensions of the works of wrist watches.

German DE-AS No. 2,004,224 discloses a wrist watch equipped with a spring drive and having a setting device for the date display and the hands which setting device facilitates rapid corrections. In this watch, in a slightly extracted axial position of the setting shaft an intermediate gear is inserted through two cooperating levers in a setting gear of the setting shaft. In the semi-extracted position of the setting shaft, this intermediate gear sits with a journal like frustum on the cylindrical surface of the setting shaft. The intermediate gear engages a coupling element with a star shaped control element rotatably mounted in an arcuate slit. Depending on the direction of rotation of the setting shaft and thus of the intermediate gear, the coupling element is moved to one of the two ends of the arcuate slit, where, during further rotation of the setting shaft the coupling element engages the star gearing of the date display disk in order to adjust the display disk in a stepped manner. In the alternate case, i.e., with rotation of the setting shaft in the opposite direction, the coupling element engages in a similar manner with the day-of-the-week display disk. In the fully extracted position of the setting shaft, the journal-like frustum of the intermediate gear slides down on a conically pointed end of the setting shaft. The intermediate gear is then disengaged from the gear of the coupling element and engages an interchangeable gear for the setting of the hands, in the clockwise or counterclockwise direction depending on the direction of the rotation of the setting shaft.

A disadvantage of this type of arrangement for a rapid date setting device is again the increased space requirement caused by the height adjustable intermediate gear for selective coupling with the hand setting gear or the rotating coupling element, depending on the extracted position of the setting shaft. Furthermore, there is the disadvantage that in the calendar display adjusting position no stationary, stable working position is provided for the coupling element. The necessary gear engagement is obtained by the constant application of torque to the setting shaft. With respect to the handling technique, there is also the particular disadvantage that the display disks for the calendar indication are adjustable in one direction only, i.e. not in both the forward and backward directions.

In the German patent application P No. 2,855,898, the present applicant has proposed a watch of this general type, wherein either the date display or the day-of-the-week disks may be adjusted independently by use of a switching lever ratcheting on an intermediate gear. The position of the switching lever is determined by the direction of the rotation of the shaft in a preselection axial position of the setting shaft. By extracting the setting shaft into the next axial position a corresponding shift is effected by a preselecting lever through the displacement of a switching element to rotate a coupling element in a slit curved in the shape of an S. In order to set the hands, the setting shaft must be brought into a further extracted position, i.e., into a third axial position. A setting gear is provided on the front end of the setting shaft and is located inside the works to engage a crown wheel fixedly attached to the works at the third position in order to effect a rotation of the hands. The calendar setting gear is disengaged in this particular position.

This proposed rapid setting device for a watch of this general type has the advantage that the calendar adjustment may be predetermined by preselection in a position of the setting shaft and that the adjustment may then be effected, following the moving of the shaft into the next axial position, by rotating the shaft in either direction, i.e., forward and backward. A disadvantage of this watch, however, again lies in the use of a lever, changed over by the actuation of the shaft during preselection, for the displacement of the coupling element in the one or the other direction and also the parts susceptibility to wear because of the ratchet action of the lever on the intermediate gear. Another disadvantage is the relatively great space requirements due to the fact that the setting of the calendar display requires a setting gear on the setting shaft and also this watch requires an independent setting gear in front of the setting shaft with a hand setting crown wheel.

Accordingly, it is an object of the present invention to provide a watch of the above-described general type with rapid setting capability of a hand and calendar adjusting device. A further object is to reduce space requirements and provide a mode of operation that is functionally reliable and easy to operate.

These objects and others are achieved by the present invention in a watch having a highly compact structural layout and thus low space requirements within the works, while providing a relatively simple design that enhances the ease of operation and is not susceptible to wear. These advantages result from the fact that in contrast to known watches, the present invention employs an intermediate gear fixedly mounted within the works and thus immobile both in the axial and transverse directions during the axial displacements of a setting shaft. The intermediate gear is arranged centrally and provided with a central function. The intermediate gear engages both a setting gear for the hands and a coupling element for the selective adjustment in any direction of the calendar display disks. The setting gear is located within the path of the setting shaft and is capable of being lifted off of the setting shaft. The coupling element is provided with three point switching capability including two stable working positions and is subject to manual preselection by the setting shaft. Further, the coupling element operates with particular reliability, because wear associated with a ratchet coupling and with support functions of preselection reversing levers (as in the case for the example of the above-described rocker with a complicated geometrical layout of the cooperating parts) no longer appears. Furthermore, the number of parts to be moved and caused to engage each other is reduced and the geometry of the arrangement is simplified.

In the first or depressed axial position of the setting shaft of the present invention, a preselection of the adjustment of the calendar display is effected dependent upon the direction of rotation of the setting shaft. Rotation of the setting shaft moves the coupling element into one of two intermediate preparatory positions while further rotation of the setting shaft results in a free rotation of the coupling element in the preparatory position, but not in any wear inducing engagement. When subsequently the setting shaft is extracted by one notch into a second axial position, a triangular slotted link acts upon the coupling element and depending upon which of the two preparatory positions has been reached in the intermediate position of the rotating coupling element, the element will be rotated by one of the two switching areas of the slotted link into a working position. The rotation of the coupling element effects a setting engagement with the date or day-of-the-week display disk, such that the display disk involved may be rotated by steps forward or backward, depending upon the rotation of the setting shaft in the second axial position.

In a second extracted position, i.e., a third axial position of the setting shaft, the slotted link is returned and the coupling element thereby brought into an intermediate position from its previous working position, and thus disengaging the calendar display disks. At the same time, the setting drive gear of the hands is displaced along its axis and is rigidly coupled in rotation with the setting shaft in order to render the selective forward or backward setting of the hands possible.

Within the scope of the invention, the correlation of the axial positions of the setting shaft with the individual adjustments or preselection functions may be selected in a manner different from that summarily described hereinabove. The correlation described is however preferred with quartz controlled electronic timing circuits since the need for an adjustment of calendar displays arises substantially more often, i.e., approximately once a month, than the requirement of setting the hands. Furthermore, it is an advantage from an operational standpoint that in the rest position, i.e., in the depressed or first axial position of the setting shaft, a playful or erroneous rotation of the setting shaft has no effect on the display function or on the normal drive function of the works. As mentioned hereinabove, rotation of the shaft in the first axial position merely rotates the coupling element into one of the two preparatory positions being the terminal settings of the intermediate position between the two working positions. Thereafter, the coupling element rotates freely without any engagement.

According to the preferred embodiment of the present invention, the slotted link for aligning the coupling element in the preselected working position is a self-securing arrangement. Consequently during the calendar display adjustment in the second axial position of the setting shaft, there is no need for any force to be applied by the setting shaft to maintain the working position of the coupling element.

According to a further feature of the present invention, a correction spider for engaging the calendar display is rotatably coupled to the coupling element by friction. Also, a correction wheel of the calendar display engages the teeth of the intermediate gear. This arrangement prevents interference with the switching of the calendar display which could occur while the coupling element was in the working position by a rigid gear connection to the manually actuated setting shaft. The frictional engagement permits the drive gear of the hands to execute the stepping motion of the calendar display even with a manually arrested setting shaft by rotating the correction spider with respect to the correction wheel of the calendar display of the coupling element.

It is further preferred that the gear connection between the setting shaft and the coupling element according to the present invention be provided with a certain backlash of the rotating motion between the setting shaft and the coupling element. The backlash may be attained by providing a clearance between at least two cooperating torque transmitting elements. This prevents the cancellation of a preselection of the coupling element effected in the first position by an accidental slight backward movement of the setting shaft during extraction into the second or actuating axial position. In this way, the action of the slotted link against the coupling element results in the working position corresponding to the preselection for the rapid adjustment of the calendar display.

BRIEF DESCRIPTION OF THE DRAWINGS

A preferred embodiment of the present invention will be described with reference to the accompanying drawings wherein like members bear like reference numerals and wherein.

DETAILED DESCRIPTION OF THE PREFERRED EMBODIMENT

Figure 1:
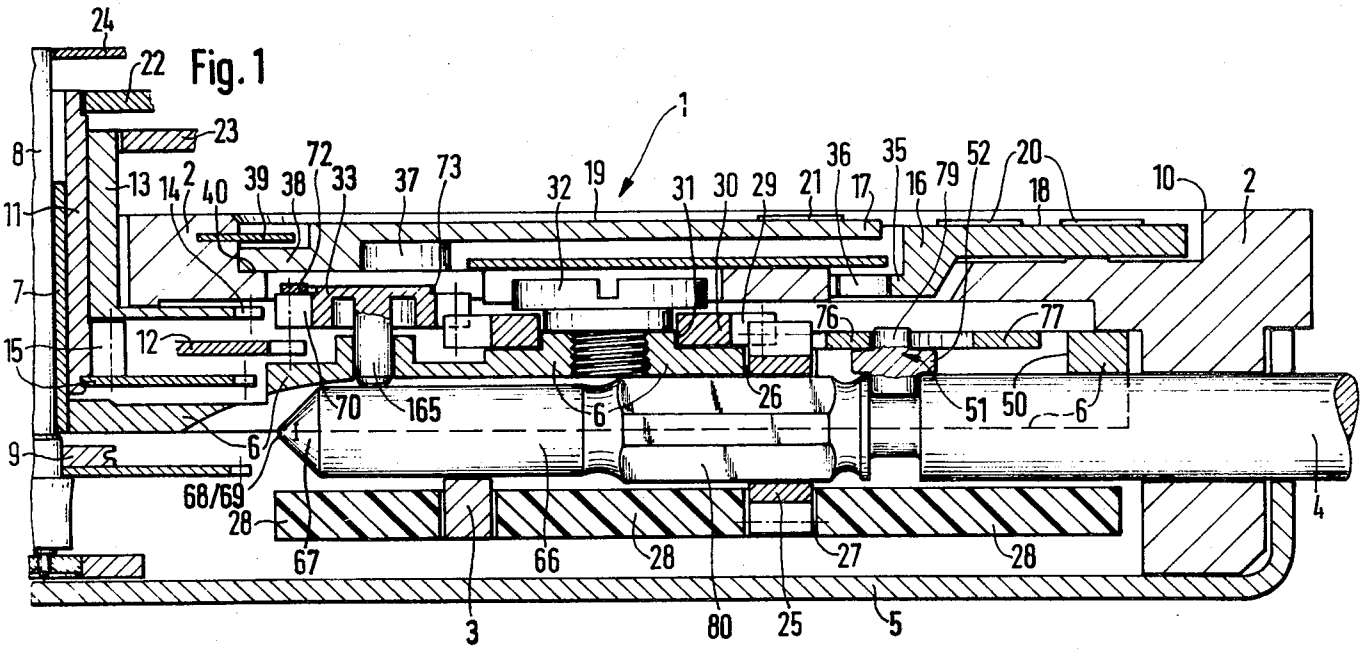
FIG. 1 is a radial cross-sectional view through the works of an electronic wrist watch with the setting shaft in its first (I) or preselection axial position and with the hands setting device disengaged.

With reference to FIG. 1, the works 1 of an electrically powered wrist watch are equipped with electronic timing, including an electronic circuit and an electromechanical drive mechanism, together with their power supply (not shown). A setting shaft 4 is mounted in a watch block 2 by a setting shaft bearing 3. The setting shaft 4 is capable of being locked in a plurality of indexing positions and is both axially displaceable and rotatable about its longitudinal axis. The setting shaft 4 penetrates the block 2 and a protective cap 5 covering the bottom of the works 1 so that the shaft 4 may be manually actuated from outside the works 1 (following insertion of a housing from outside the case of the wrist watch) by a handle in the form of a crown (not shown).

A works board 6 is arranged in the works 1 wherein a mounting tube 7 is upstandingly anchored. A seconds hand shaft 8 is concentrically arranged within the mounting tube 7 which shaft 8 is drivingly connected inside the works block 2 by a gear 9 with the electromechanical drive mechanism controlled by the electronic timing circuit. The drive may consist, for example, of a stepping motor (not shown in the drawing). The opposite, free end of the seconds hand shaft 8 protrudes past a surface 10 of the works block 2 and hold a dial (not shown). On an external circumferential surface of the mounting tube 7 a minute hand tube 11 is arranged which tube 11 protrudes to a lesser extent past the surface 10 and is rotatably connected at its opposite end inside the block 2 by gears (not shown) with an interchangeable gear 12 for the setting of the hand (see hereinbelow). The minute hand tube 11 carries an hour hand tube 13, which penetrates even less over the surface 10 and is drivingly connected by a toothed gear flange 14 inside the block 2 with one of the toothed gears 15 of the drive mechanism for driving the minute hand tube 11 in conjunction with the rotating motion of the second hand shaft 8.

Date and day-of-the-week display disks 16, 17 respectively arranged concentrically with respect to each other and to the axis of the mounting tube 7 in the present preferred embodiment, are drivingly connected with the hour hand tube 13 and are advanced by a scale division by a switching mechanism (not shown) of conventional design, for each complete revolution of the hour hand tube 13 in the course of a 24 hour day. The date and day-of-the-week disks may be adjusted for setting purposes independently of each other (see hereinbelow) by the setting shaft 4. In the illustrated embodiment, the date display disk 16 is of an annular configuration in order to contain concentrically within itself the day-of-the-week display disk 17 in approximately the same plane. Date indications 20 and day-of-the-week indications 21 are printed or engraved on surface 18, 19 of the display disks respectively. The indications are displayed in mutual coordination in a known manner through sight windows in the dial (not shown) arranged over the works block 2.

For the setting movement of the minute hand 22 and thus the hour hand 23 (a potentially present electromechanical reset device for the null setting and arresting of the second hand 24 during the hand adjusting operations is not shown in FIG. 1), an adjusting wheel 25 is slidably mounted on the setting shaft 4 with the adjusting wheel 25 being rotatably connected with the shaft 4. The wheel 25 is arranged in a groove 26 in the works board 6 and possible, as shown, in a perforation 27 in a circuit board 28 for the electronic timing circuit to axially confine the wheel 25 during axial displacement movements of the setting shaft 4.

An intermediate gear 30 is drivingly connected with a ring gear 29 by, for example, a frontal toothing or crown toothing of the adjusting wheel 25. The intermediate gear 30 is rotatably mounted on a shoulder 31 acting as a rotation bearing by a stepped shaft of a screw 32. The intermediate gear 30 is drivingly connected by toothing both with a hand setting wheel 33 and with a display correction wheel 34 (FIG. 2), preferably in a constant manner, i.e., independently of the instantaneous actuation and/or position of the setting shaft 4. However, depending on the actuating prehistory and/or the instantaneous axial position of the setting shaft 4, the coupling of the shaft setting wheel 25 through the hand adjusting wheel 33 or the display correction wheel 34 with the drive mechanism of the hands (i.e., with the toothed gears 15 of the minute hand) or with one of the stepping teeth of the display disks 16 or 17, may be effected in either direction. In this way, individual directional adjustments by the setting shaft 4 are possible without limiting conditions such as functional links between the adjustments.

For the stepping advance of the display, the annular date display disk 16 has a flange-shaped collar 53 on an inner wall which collar 35 carries star-shaped internal toothing 36. The day-of-the-week display disk 17 is equipped with similar star-shaped external toothing 37 on an outside of a recessed rim 38. The day-of-the-week display disk is rotatably mounted between a Seeger ring 39 and a shoulder 40 arranged on the works block 2 concentrically with respect to the mounting tube 7.

The inserted axial position of the setting shaft 4 (shown in FIGS. 1 and 2) is the first axial position (I) or the ground position. In this position no setting of the hands or the display disks takes place by, for example, an accidental rotation of the setting shaft 4. Rather, this ground position serves as a preselection position for determining whether a rotating motion of the shaft 4 in a second axial position (II), i.e., in the first extracted position, is to alter the date display or the day-of-the-week display (see hereinbelow the explanation of FIGS. 3 to 5).

In the first axial position (I), a rotatably mounted coupling element 41 (FIG. 2) is moved into one of two preparatory positions by the rotation of the setting shaft 4. The coupling element 41 is transferred from the preparatory positions during the pulling of the setting shaft 4 from the first axial position (I) into the second axial position (II) into a coordinated stable working position, wherein the coupling element 41 establishes a driving connection from the rotatable setting shaft 4 to either the day-of-the-week display disk 17 or the date display disk 16.

For this purpose, the coupling element 41 consists of a display correction wheel 34 and a correction spider 42 rotatably connected with the wheel 34 by a frictional coupling. The frictional coupling is located on the same rotatably mounted shaft 43 (FIG. 2) in the preferred embodiment of the present invention. This frictional coupling ensures that no functional disturbance or damage will occur when, as a result of an instantaneous stepping advance of the hour hand, a change of the day stepping advance should take place even during engagement of the correction spider 42 with the toothings 36 or 37. The day stepping advance will not be blocked by the coupling to the intermediate gear 30, but may be completed without interference while taking along the correction spider 42, i.e., rotating the spider 42 with respect to the display correction wheel 34.

In order to rotate the coupling element 41 into the one or the other preparatory position, the setting shaft 4 is turned in the first axial position (I) in one or the other direction. Through the rotating coupling of the shaft to the setting wheel 25 and the intermediate gear 30, a rotating motion is transmitted to the display correction wheel 34 the shaft 43 of which is not secured rigidly to the apparatus, but may be displaced transversely to the axis of the wheel 34.

For swivelling motion of the coupling element 41, the shaft 43 is guide both in an arcuate slit 44 in the board 6 and in a slotted link 45 in a switching lever 46 which link 45 extends curvingly in a direction opposite to the arcuate slit 44. The transverse displacement of the shaft 43 between the two preparatory positions takes place within the arcuate slit 44 which concentrically rims a portion of the intermediate gear 30. Because the path of rotation is of the order of magnitude of the diameter of the shaft 43 and thus relatively small, the transverse displacement is approximately linear along a tangent to the circular rim of the arcuate slit 44 in the central area of the overlap of the arcuate slit 44 by the opposingly curved slotted link 45. The slotted link 45 is formed in a generally triangular configuration by two slits 47 extending angulary with respect to each other. The slotted link 45 has an approximately rectangular internal angle 48 of the triangle. The two slits 47 forming the legs of the triangle contact each other externally in an approximately straight line rim 49 of the slotted link 45, which rim 49 extends in a generally straight line or approximately in the shape of the arcuate slit 44. The rim 49 extends between the two preparatory positions for the swivelling shaft 43, from where this external rim 49 of the slotted link 45 bends downwardly into the external edging of the slits 47 forming the legs of the triangle.

The dimensions of the correction spider 42 are such that the spider 42 does not engage the star-shaped toothings 36 and 37 of the display disks 16 and 17 respectively in either of these two preparatory positions or in an intermediate position. The user may thus continue the direction of rotation for the preselection of the display correction in the first axial position (I) of the setting shaft 4 even after the rotation of the coupling element 41 into the corresponding preparatory position. The continual rotation in one direction does not cause any functional interference or abrasive phenomena because the coupling element 41 is able to rotate freely after rotating displacement into the directionally dependent preparatory position with the shaft 43 abutting against the end of the approximately straight line rim 49 of the slotted link 45. Upon a change in the direction of rotation of the setting shaft 4, the coupling element 41 is moved into the opposite preparatory position.

Figure 3:
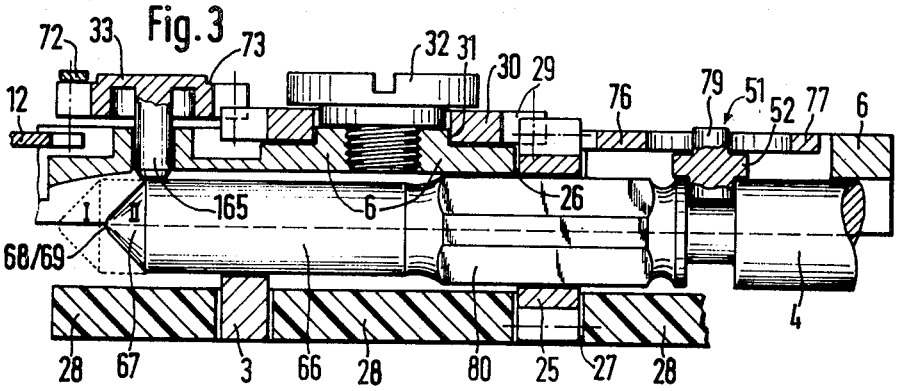
FIG. 3 is a view of a portion of FIG. 1 with the setting shaft in a first extracted position, i.e., in the second (II) or calendar display correcting axial position.
Figure 4:
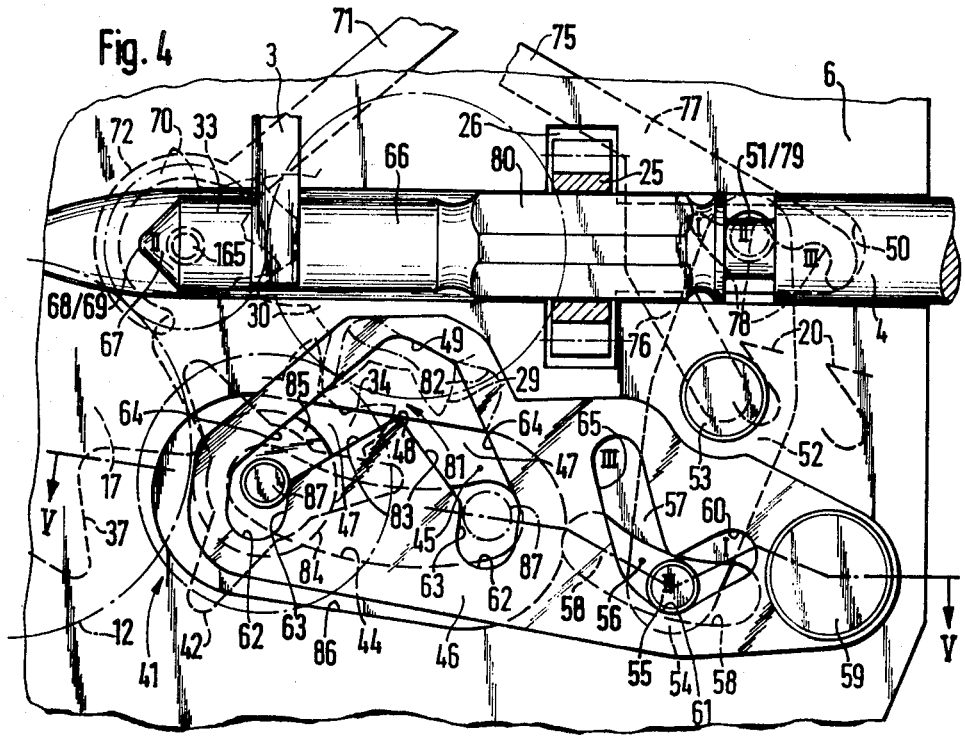
FIG. 4 is a bottom view similar to FIG. 2 following the rotation of the coupling element from the preparatory position of FIG. 2 into the stationary working position to correct the day-of-the-week display in the axial position of the setting shaft as in FIG. 3.
Figure 5:
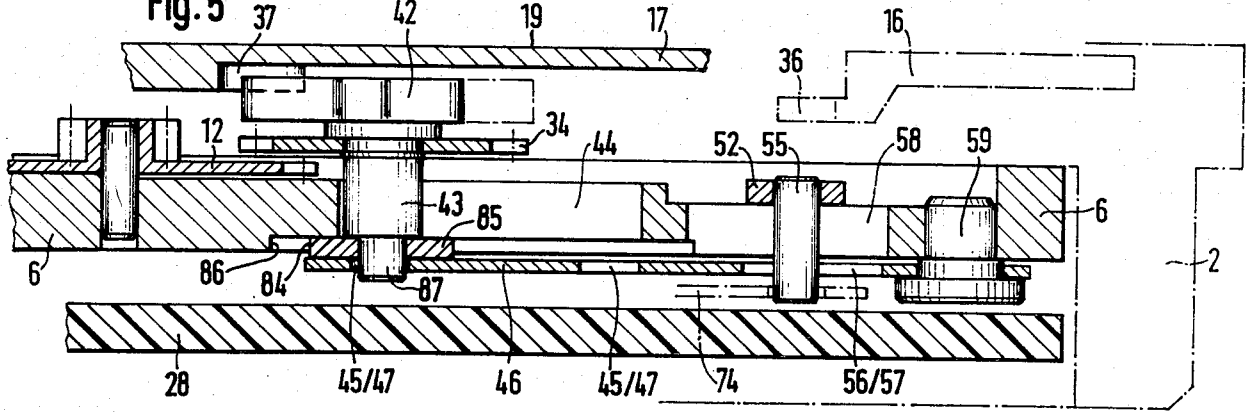
FIG. 5 is an angled cross sectional view in the working position of the coupling element according to FIG. 4 along the line V—V FIG. 4.

The mechanical engagement of the correction spider 42 with either the toothing 36 or 37 of the display disks, depending upon the preparatory position occupied previously, occurs only after the transition into the corresponding stationary working position of the coupling element 41 as the result of the extraction of the setting shaft 4 from the first axial position (I) into the second axial position (II) (FIGS. 3 to 5). The calendar correction position is the first extracted position or the second axial position (II) of the shaft 4.

With reference to FIG. 3, compared with the corresponding representation in FIG. 1, the hand setting wheel 33 remains in the lift-off position in the second axial position (II) and thus is disengaged from the interchangeable gear 12 for the manual setting of the hands. By displacement of the setting shaft 4 in the outward direction from the first or preselection position (I) to the second or calendar correction position (II), a sliding stone 51 engaging a circular groove 50 in the setting shaft 4 is carried along with a reversing lever 52 which is connected with the sliding stone 51.

The reversing lever 52 is a dual arm layout in the preferred embodiment. The lever 52 is thereby swivelled around a journal 53 during the axial displacement of the setting shaft 4. The journal 53 is fixedly mounted in the works. The movement results in a corresponding motion of the reversing end 54 of the lever 52, according to the law of lever action. A pin 55 arranged near the end 54 engages an angled lever guide 56, in the case of the present example, a knee-like, angled groove 57, in the switching lever 46. Guidance without tilting is obtained by the hingling of the lever 52 on the fixedly mounted journal 53, which penetrates the lever 52 with a relatively large diameter. The free front end of the actuating pin 55 protrudes into a recess 58 in the board 6 within the swivelling range of the reversing end 54. The arrangement and dimensions of the reversing lever 52 and the cooperation with the switching lever 46, which in the case of the present example consists of a one-arm lever swivelling around a fixedly mounted stump of a shaft 59, are such that a motion of the pin 55 along an arc swivels the switching lever 46 toward the intermediate gear 30 by contact of the pin 55 with the rim of the lever guide 56 which contact moves the pin 55 in the lever guide 56 from an end 60 of the angular leg to the apex of the angle 61.

Upon the swivelling of the switching lever 46, the internal angle 48 of the triangular slotted link 45 moves toward the shaft 43 of the coupling element 41. Depending on the preparatory position selected in the first axial position (I), the shaft 43 moves to the left or to the right of the apex of the internal angle 48 of the triangle (see FIGS. 2 and 4). Upon the further swivelling of the switching lever 46, the shaft 43 is shifted from the left or the right slits 47 of the link 45 in the arcuate slit 44 further to the left or the right into a corresponding stationary working position (FIG. 4). In the course of the motion from the apex of the internal angle 48 of the triangle the shaft 43 is finally moved into an end 62 of the leg 47 that is angled with respect to the rest of the slit 44.

Figure 2:
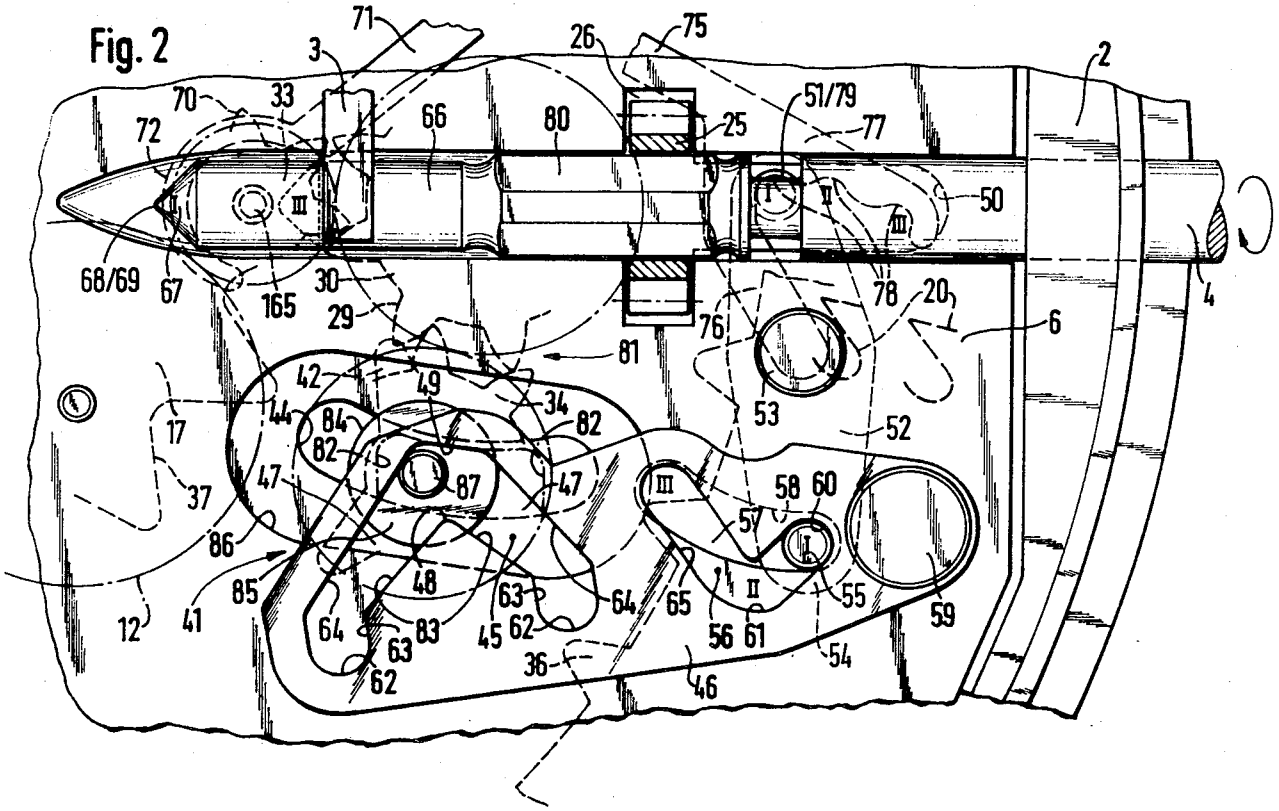
FIG. 2 is a bottom view of a portion of the arrangement of FIG. 1 with the protective hood and the circuit board removed and with the calendar display coupling element in an intermediate preparatory position for a day-of-the-week display correcting position.

An inclination 63 of the inner rim of the leg 47 with respect to the radius of the arcuate slit 44, when the switching lever 46 is raised (FIG. 4), provides a stable working position for the coupling element 41 at the corresponding end of the arcuate slit 44 as the result of self-retention. In other words, a tendency of the shaft 43 in the arcuate slit 44 to move back out of this working position would lead merely to a further securing along the inner rim 63 within the end 62 of the leg 47. Only by downward motion of the switching lever 46 may the shaft 43 be moved out of the end 62 of the leg and displaced along the outer wall 64 of the leg inclined in the opposite direction with respect to the radius into the preselection position (FIG. 2).

In the stable working position of the shaft 43 in the end 62 of the leg (FIG. 4) and thus a stable position of the coupling element 41 as determined by the preselection, the correction spider 42 engages the corresponding toothing of the display (in FIG. 4 the toothing 37 of the day-of-the-week display disk 17). The rotation of the setting shaft 4 into the second position (II) or calendar correction position thus effects a stepped advance or retardation of (in the case of FIG. 4) the display of the name of the week. The opposite stable working position of the shaft 43 (indicated in FIG. 4 by a dash-and-dot line), which is obtained after a correspondingly effected preselection in the opposite direction, would therefore lead to a stepping adjustment of the date display as the result of the engagement of the correction spider 42 with the inner toothing 36 of the date display disk 16 (FIG. 2).

Figure 6:
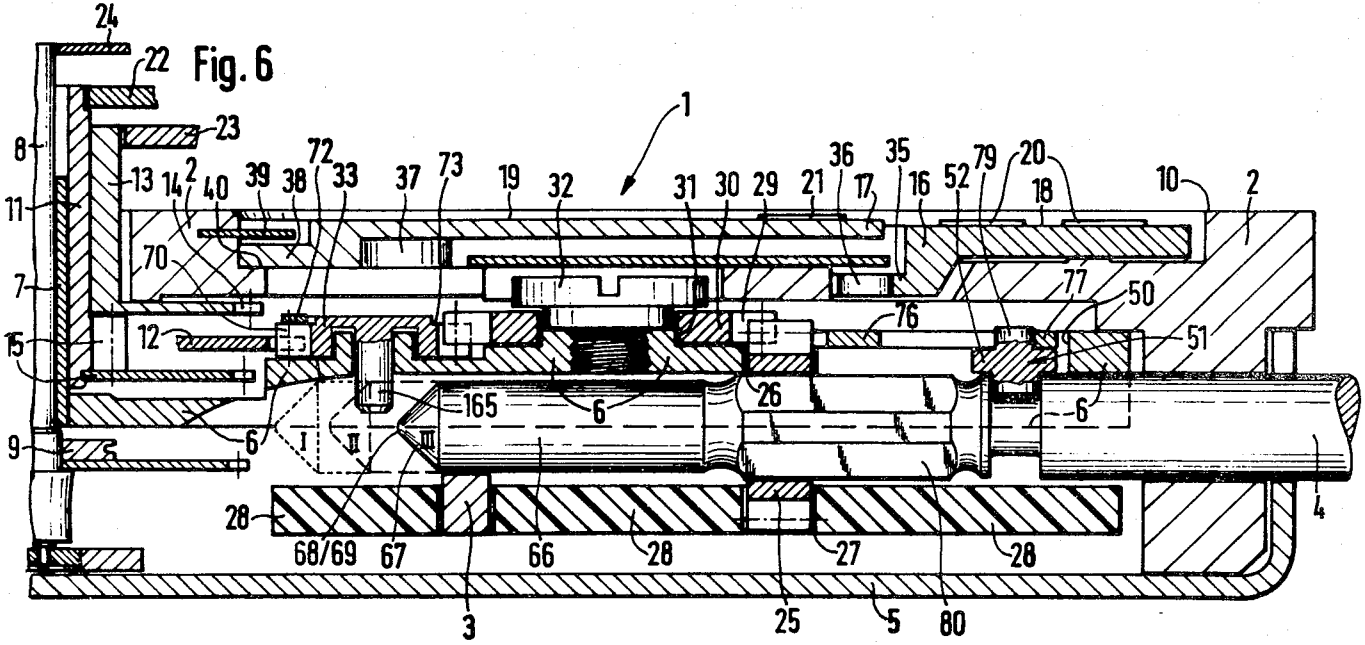
FIG. 6 is a view similar to FIG. 1 with the hands setting wheel coupled to the setting shaft after the setting shaft has been moved to the second extracted position, i.e., the third (III) or hands correction axial position.
Figure 7:
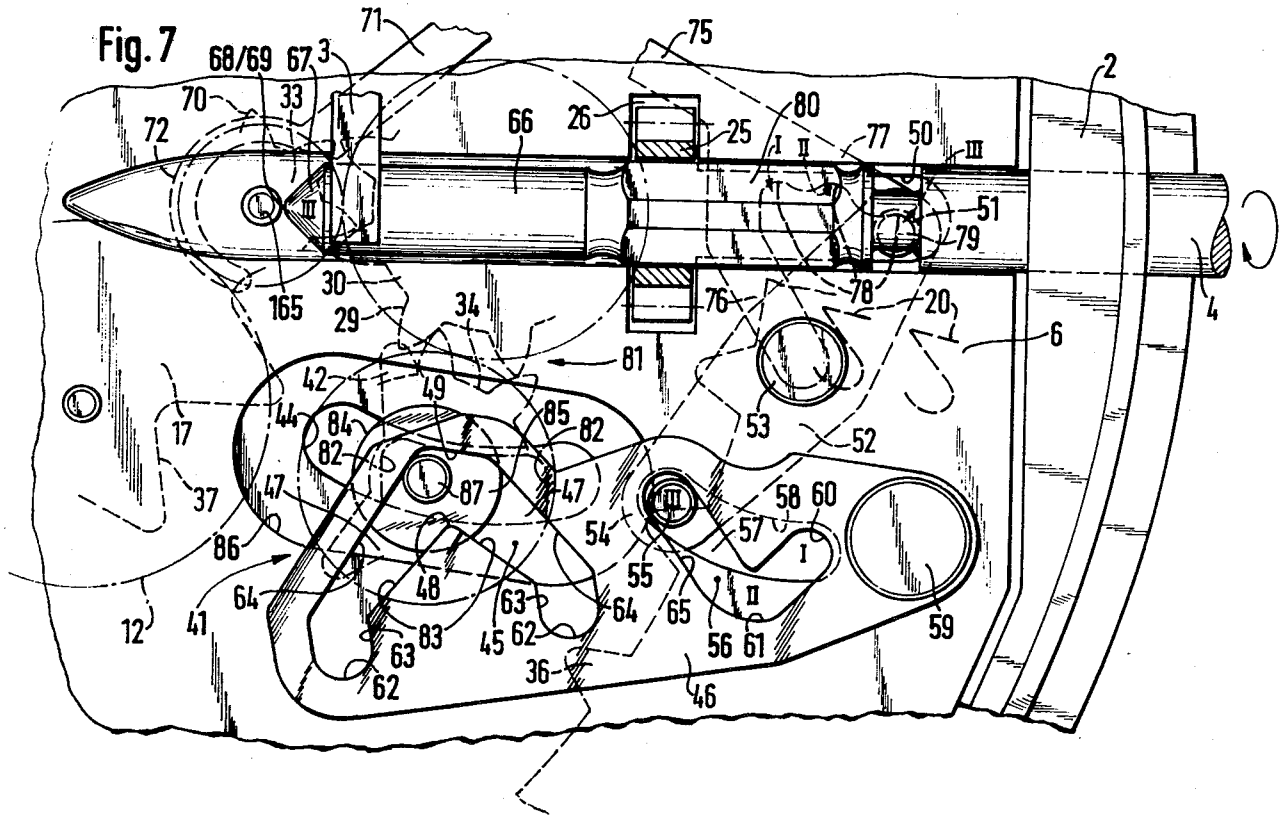
FIG. 7 is a bottom view similar to FIGS. 2 and 4 with the coupling element returned to the intermediate position and thus disengaged from the calendar display disks, as the result of the setting shaft being placed in the third axial position (III).

An axial movement of the setting shaft 4 from the second axial position (II) into a third axial position (III) or a second extracted position (FIGS. 6 and 7) causes a further swivelling of the reversing lever 52 and a corresponding displacement of the pin 55 in the arcuate recess 58 while being supported against an external wall 65 of the angular groove 57. This exerts pressure on the switching lever 46 and rotates the lever around the shaft stump 59 from the calendar display correction position (FIG. 4) corresponding to the second axial position (II) of the setting shaft 4 into the neutral position (FIG. 7) corresponding to the preselection position (FIG. 2). At this time, the correction spider 42 is disengaged and located between the two star-shaped calendar display toothings 36, 37, as the result of the return of the coupling element 41 into the preselection or central range of the arcuate slit 44. It is also possible (not shown in the drawing) to use the clearance between the shaft 43 and the adjacent rims of the arcuate slit 44 and the slotted link 45 to affect the coupling device 41 so that the toothing of the calendar display correction wheel 34 is disengaged from the intermediate gear 30 rotatably connected to the setting shaft 4. In this way, in the third axial position (III), even though harmless, swivelling and free rotation of the coupling element 41 in the course of the setting of the hands is prevented.

To set the hands by rotation of the minute hand 22 (FIG. 1), the setting shaft is moved from the second axial position (II) to the third axial position (III). During the transition of the setting shaft 4, a shaft frustum 165 of the hand setting wheel 33 aligned transversely to the longitudinal axis of the setting shaft 4 moves downwardly from the cylindrical circumferential surface 66 of the setting shaft 4, by way of a bevel 67 to a narrowed area 68 of the shaft 4. In the illustrated embodiment, the narrowed area 68 is at the front end 69 of the setting shaft 4 and is designed in the shape of a truncated cone. Thereafter, the toothing 70 engages the toothing of the hand setting changeable gear 12. In order to secure this engagement effected by the axial displacement of the hand setting wheel 33, a leaf spring 71 is provided, with one end attached to the block 2 and the other end, preferably in the shape of a circular arc 72 pressed against a circumferential shoulder 73 of the hand setting wheel 33 in the direction of the linkage.

In the third axial position (III) of the setting shaft 4, rotation of the shaft 4 in any direction leads to a corresponding rotation of the minute hand 22 and thus of the hour hand 23. Also, rotation results in a change in the calendar indication by the date and day-of-the-week display disks 16, 17 after the passage of 24 hours by the hour hand 23.

In order to execute a reset function from the third axial position (III) of the setting shaft 4, i.e., in the position for the setting of hands, there may be provided conveniently between the circuit board 28 and the switching lever 46 an electromechanically acting reset contact spring 74 (FIG. 5). The reset contact spring 74 is actuated by the actuating pin 55 of the reversing lever 52 when the pin 55 is moved into the terminal position of the lever guide 56 (shown in FIG. 7) corresponding to the third axial position (III) of the setting shaft 4.

To secure both positively and frictionally each of the three selectable, discrete axial positions of the setting shaft 4, a spring bar 75 ending in two tines is preferably provided. The spring bar 75 is attached at one end (not shown) to the block 2 and rests with one tine 76 under spring loading on the journal 53 of the reversing lever 52. This permits the reversing lever 52 to lift the sliding stone 51 radially from the groove 50 of the setting shaft to replace the setting shaft 4. The second tine is provided with an internally profiled tine 77 having three indentations 78, into which, depending on the instantaneous position of the reversing lever 52, a pin 79 of the sliding stone 51 is pressed.

In the handling of the correcting setting device, the user may erroneously or without noticing impart a certain backward rotation to the setting shaft 4 when extracting the setting shaft 4 from the first or preselection axial position (I) into the second or calendar correction position (II). In order to ensure that the preparatory position of the coupling element 41 occupied as the result of the preselection rotation in the first axial position (I) is not reversed, i.e., that the slit 47 of the link 45 of the switching lever corresponding to the preselection rotation actually engages the shaft 43 of the coupling element, it is preferred to provide a certain clearance in the drive sequence from the setting shaft 4 through the wheels 25 and 30 to the calendar correction wheel 34. This clearance may be accomplished for example by allowing a certain backlash in the sliding fit for the transmission of torque between the setting shaft adjusting wheel 25 and the profiled part 80 of the shaft in the direction of the circumference of the shaft (direction of rotation of the setting shaft) with respect to a reversal of the direction of rotation.

In a preferred arrangement (shown in FIG. 2), a relatively large gearing clearance is provided at some location in the gearing 81, for example, between the intermediate gear 30 and the calendar correction wheel 34. This clearance may be provided in a particularly simple manner by breaking out (eliminating) every second tooth in the interacting gears. In this way, only after a relatively large (due to the translation from the setting shaft adjusting wheel 25 to the intermediate gear 30) reverse motion of the setting shaft 4 will a force in the opposite direction be transmitted to the coupling element 41 to return the element 41 from the preparatory position just occupied.

When additional functions (not illustrated) are to be performed by the setting shaft 4 (for example the winding of a spring drive in the case of a spring powered mechanical watch), these functions may be accomplished simply, while retaining the abovedescribed design arrangement, by providing a stepped sequence of bevels 67 and narrowings 68 on the setting shaft itself or on a structural part displaceable together with the shaft. In this way, different positions in height may be realized for different gear engagements of the adjusting wheel 33.

In order to ensure that in the intermediate position of the switching lever 46 the coupling element 41 is moved into one of the two slits 47 of the slotted link 45, i.e., to promote the occupancy of unambigous preparatory positions, protrusions 82 may be provided on the legs at the transition from the outer walls 64 of the legs to the approximately straight line rim 49 of the slotted link 45, the protrusions preferably extend at least approximately along radii of the arcuate slit 44. The protrusions ensure that the shaft 43 of the coupling element is clearly located past the inner angle 48 of the triangle. In this way, the triangle cannot occupy a blocking position against the shaft 43 during the switching of the lever 46. Also, the shaft 43 contacts the inner wall 83 of the legs only after initiation of the motion of the lever 46, i.e., the corresponding additional counter force is applied only after the onset of axial movement of the setting shaft 4 from the depressed or first position (I) into the first extracted or second position (II). This arrangement facilitates the transition from the depressed position and the handling of the setting device in general.

Additionally, an obstruction (not shown) may be provided in the central region of the slotted link 45, which must be overcome during the preselection movement of the coupling element 41 from the one to the other preparatory position. Such an obstruction also acts to prevent the return of the coupling element 41 into the other preparatory position or into an undefined intermediate position between the two preparatory positions upon an unintentional slight reverse rotation of the setting shaft 4. Such an obstruction may be arranged as a region of increased frictional resistance by use of a suitable surface treatment of the sliding parts. Alternatively, an appropriate deformation of the approximately straight line rim 49 of the slotted link 45 may be provided, for example, by the formation of a slight hump to be overcome during the transition from one preparatory position to the other.

It is particularly advantageous to equip the shaft 43 of the coupling element 41 in the area of the end facing the lever 46 with a collar-like, circumferential flange 84, which may consist for example of a disk 85 fastened rigidly in rotation to the shaft 43 (FIG. 5). The disk 85 is secured in a milling cut 86 or a similar recess on the plate 6, while the shaft 43 penetrates with a pin 87 through the flange 84 and engages the slotted link 45 in the lever 46. The lever 46 is preferably made of a thin, elastic steel strip so that the lever 46 acts as a flat spring pressing against the plate 6 by the stump 59 of the shaft. The flange 84 is thereby pressed against the plate 6 inside the milling cut 86 for guiding the coupling element 41 on the block 2. Furthermore, the flange guide favors the guidance of the shaft 43 of the coupling element during rotation under the torque effect of the intermediate gear 30 on the calendar correction wheel 34 because the tendency of the coupling element 41 to move in the slit 47 along the arcuate slit 44 within the range of the milling cut 86 in the block results in the support of the flange 84 on the flat spring lever 46. This support facilitates the rotation, together with the simultaneous displacement of the coupling element 41, in the arcuate slit 44 by lever action.

The setting device according to the present invention thus makes it possible to eliminate complicated layouts and courses of motion, possibly with consideration of spring arm couplings, and still provides a reliably operating rapid calendar and watch hand corrections with a relatively small mechanical effort.

The principles, preferred embodiment and mode of operation of the present invention has been described in the foregoing specification. However, the invention which is intended to be protected is not to be construed as limited to the particular embodiment disclosed. The embodiment is to be regarded as illustrative rather than restrictive. Variations and changes may be made by others without departing from the spirit of the present invention. Accordingly, it is expressly intended that all such variations and changes which fall within the spirit and scope of the present invention as defined in the appended claims be embraced thereby.

What is claimed is:

1. A watch with a calendar display and a hands setting device, comprising a setting shaft having a plurality of axial positions, the calendar display and the hands setting device being selectively coupled for rotation with the setting shaft as a function of the instantaneous axial position of said setting shaft, the setting shaft is drivingly connected during the transition from a first preselection axial position into a second calendar correction axial position through a reversing lever with a coupling element that may be rotated into one of two preselectable working position, the setting shaft is rotatably connected in the first preselection axial position with the coupling element to move the coupling element to one of two preparatory positions for the two working positions dependent upon the direction of rotation of the setting shaft, the setting shaft being rotatably disengaged from the calendar display in the first axial position, a slotted link acting on the coupling element during movement of the shaft from the first to the second axial position to urge the coupling element into the preselected working position in engagement with either a date display disk or a day-of-the-week display disk, a third axial position of the setting shaft for the setting of the hands, the coupling element being returned by the slotted link into an intermediate position and held between the two preparatory positions in the third axial position, and the setting shaft being rotatably connected with the minute hand in the third axial position through a hand setting wheel displaceable along an axis of the wheel in a direction transverse to a longitudinal axis of the setting shaft.

2. The watch according to claim 1, wherein the coupling element is guided in an arcuate slit and in the slotted link which extends curvedly in a direction opposite to that of the said arcuate slit, the arcuate slit being concentric with an intermediate gear which in both the first preselection axial position and the second calendar correction axial position of the setting shaft establishes a rotating connection between the setting shaft and the coupling element.

3. The watch according to claim 2, wherein the coupling element comprises a calendar display correction wheel and a correction spider rotatably connected with each other, the correction spider in the working position of the coupling element is engagable with star-shaped toothing of either the date display disk or the day-of-the-week display disk as a function of the preselection.

4. The watch according to claim 3, wherein the rotatble connection between the calendar display correction wheel and the correction spider is accomplished by friction.

5. The watch according to claim 2,3 or 4, wherein the slotted link is formed in a shape similar to a triangle by abutting slits forming legs of the triangle, outer walls of the legs of the triangle merge into each other along a straight line rim of the link opposite an internal angle of the triangle formed by the inner walls of the legs, the straight line rim in the preselection axial position of the setting shaft corresponds generally to a tangent to a rim of the arcuate slit or to the slit itself.

6. The watch according to claim 5, wherein the legs of the slotted link have angled, free ends, an inner rim of the end of each leg corresonding with an existing preselected working position corresponds to a radius of the arcuate slit passing through said end of the leg or is inclined with respect to said radius in a direction opposite to the outer wall of the leg when the setting shaft is in the second calendar correction axial position.

7. The watch according to claim 2,3 or 4, further comprising a switching lever drivingly connected by the reversing lever with the setting shaft for moving the coupling element from a preselected preparatory position into one of the two stationary working positions during the transition of the shaft from the first preselection axial position into the second calendar setting axial position, and a pin attached to the reversing lever engaging a lever guide with an angled configuration in the switching lever.

8. The watch according to claim 3 wherein a clearance is provided in the rotating connection between the setting shaft and the calendar display correction wheel.

9. The watch according to claim 8, wherein the clearance comprises a gap between the teeth of either the intermediate gear or the calendar display correction wheel, said gap being substantially larger than the width of the teeth of the gear and wheel.

10. The watch according to claim 1, wherein the hand setting wheel is displaced axially during the transition of the setting shaft into the third hand setting axial position by a shaft frustum which rides along a cylindrical circumferential surface of the setting shaft and a bevel on said shaft into a narrowed region of the shaft.

11. The watch according to claim 5, further comprising protrusions on the legs provided at the transition from the outer walls of the legs to approximately straight line rim of the slotted link, said protrusions extending at least approximately along radii of the arcuate slit.

12. The watch according to claim 5, wherein the straight line rim of the slotted link is provided with an obstruction in a central area.

13. The watch according to claim 7, wherein a shaft of the coupling element is provided with a collar-like circumferential flange said flange protruding past the rim of the lever guide in the switching lever.

14. The watch according to claim 13, wherein the switching lever is designed in the form of a flat spring which presses the flange against a works block for the watch.

* * * * *